US005666688A

United States Patent [19]

Kim

[11] Patent Number: 5,666,688

[45] Date of Patent: Sep. 16, 1997

[54] CLEANER HAVING A SWITCH BUTTON FOR OPERATING A POWER ON/OFF SWITCH AND A CORD-WINDING UNIT

[75] Inventor: Suk-Gu Kim, Bucheon, Rep. of Korea

[73] Assignee: Daewoo Electronics Co., Ltd., Seoul, Rep. of Korea

[21] Appl. No.: 579,014

[22] Filed: Dec. 27, 1995

[30] Foreign Application Priority Data

Feb. 8, 1995 [KR] Rep. of Korea ..... 95-1893

[51] Int. Cl.[6] ..... A47L 9/26

[52] U.S. Cl. ..... 15/323; 15/339

[58] Field of Search ..... 15/323, 339

[56] References Cited

U.S. PATENT DOCUMENTS

| | | | |
|---|---|---|---|
| 2,905,274 | 9/1959 | Cook | 15/323 X |
| 3,339,030 | 8/1967 | Nilsson | 15/323 X |
| 3,619,850 | 11/1971 | Rideout et al. | 15/323 |
| 3,651,536 | 3/1972 | Bolzan et al. | 15/323 |
| 3,999,640 | 12/1976 | Persson | 15/323 X |
| 4,299,007 | 11/1981 | Hug | 15/323 X |
| 4,592,764 | 6/1986 | Ikezaki et al. | 15/323 X |

FOREIGN PATENT DOCUMENTS

| | | | |
|---|---|---|---|
| 569088 | 1/1924 | France | 15/323 |

*Primary Examiner*—Chris K. Moore

*Attorney, Agent, or Firm*—Beveridge, DeGrandi, Weilacher & Young, LLP

[57] ABSTRACT

Disclosed is a cleaner having a switch button for operating a power on/off switch and a cord-winding unit, which comprises a switch button for operating the power on/off switch and the cord-winding unit by performing seesaw movements of the switch button, and a body having a switch button receiving recess for receiving the switch button therein, to thereby enable the assembly processes of the button to become simpler and require less of a time period therefor.

4 Claims, 3 Drawing Sheets

CLEANER HAVING A SWITCH BUTTON FOR OPERATING A POWER ON/OFF SWITCH AND A CORD-WINDING UNIT

BACKGROUND OF THE INVENTION

1. Field of the Invention

The present invention relates to a cleaner, more particularly to a cleaner having a switch button for operating a power on/off switch and a cord-winding unit.

2. Description of the Prior Art

In general, a cleaner has a power on/off switch and a cord-winding unit operation switch. FIG. 1 is a perspective view for showing a body 3 of a conventional cleaner 1 equipped with a power on/off switch 6 and a cord-winding unit operation switch 7. As illustrated in FIG. 1, in cleaner 1, power on/off switch 6 is separated from cord-winding unit operation switch 7. Power on/off switch 6 and cord-winding unit operation switch 7 are installed in body 3 of cleaner 1. Reference numeral 4 indicates a hosepipe. Hosepipe 4 provides an air passage from the exterior to body 3. Reference numeral 5 indicates a connection/separation part. Connection/separation part 5 connects or separates hosepipe 4 with or from body 3.

FIG. 2 is a cross-sectional view for power on/off switch 6 installed in body 3 of FIG. 1. As illustrated in FIG. 2, power on/off switch 6 includes an on/off switch button 61. A protrusion 63 is formed in the inner side of on/off switch button 61. Further, limiting parts 9 are formed on both sides of on/off switch button 61. Limiting parts 9 are inserted in body 3. Accordingly, on/off switch button 61 is movable up and down, but is not separated from body 3 due to limiting parts 9. Further, a push button switch 80 is installed under on/off switch button 61. Push button switch 80 includes a switch head 81. When on/off switch button 61 is pressed, protrusion 63 presses switch head 81. Accordingly, whenever on/off switch button 61 is pressed, push button switch 80 repeatedly turns on and off.

FIG. 3 is a cross-sectional view for cord-winding unit operation switch 7 installed in body 3 of FIG. 1. As illustrated in FIG. 3, cord-winding unit operation switch 7 includes a wire-winding unit switch button 71 and a cord-winding unit 11. Cord-winding unit switch button 71 is inserted in body 3 and cord-winding unit 11 is installed in body 3.

The lower section of cord-winding unit switch button 71 is laid on a cord-winding unit operation lever 10 of cord-winding unit 11. One end of cord-winding unit operation lever 10 is connected with one end of a stop lever 14. The other end of cord-winding unit operation lever 10 is rotatably fixed to cord-winding unit 11. Stop lever 14 controls the incoming and outcoming of a power cord 12 into and out of cord-winding unit 11. Usually, wire 12 is wound up around a reel 15. The other end of stop lever 14 is rotatably fixed to cord-winding unit 11 and is connected with a stop roller 13 which controls the rotation of reel 15.

Since the conventional cleaner mentioned above has an on/off switch button and a cord-winding unit switch button, assembly processes of the buttons become complicated and require too long a time.

SUMMARY OF THE INVENTION

Accordingly, it is an object of the present invention to provide a cleaner having a switch button for operating a power on/off switch and a cord-winding unit.

In order to obtain the above object, the present invention includes a switch button for operating a power on/off switch and a cord-winding unit. The switch button is formed in a shape of a lidless rectangular box. First and second protrusions are formed on the middle portions of two opposite sides, respectively. The first and second protrusions are made of elastic materials. A third protrusion is formed near one end portion of the inner bottom of the switch button. A plurality of tapered rib protrusions are formed on the lower portion of the third protrusion. Further, a spring is inserted in the third protrusion. One end of the inserted spring is fixed on the rib protrusions. In order to connect the switch button with a body of a cleaner , a switch button receiving recess for receiving the switch button is formed on the body of the cleaner. On the middle portions of the opposite walls of the receiving recess, first and second protrusion receiving recesses are formed in order to receive the first and the second protrusions respectively. First and second openings are formed on the bottom of the switch button receiving recess. The third protrusion is laid on the cord-winding unit operation lever of the cord-winding unit through the first opening. The push button switch for a power on/off operation is installed in the second opening. Therefore, the on or off of a power supply or the operation of the cord-winding unit depends on the position where the switch button is pressed.

BRIEF DESCRIPTION OF THE DRAWINGS

The present invention may be better understood and its numerous objects and advantages will be more apparent to those skilled in the art by reference to the accompanying drawings in which.

DESCRIPTION OF THE PREFERRED EMBODIMENT

An embodiment of the present invention will be explained hereunder with reference to the accompanying drawings.

Figure 4:
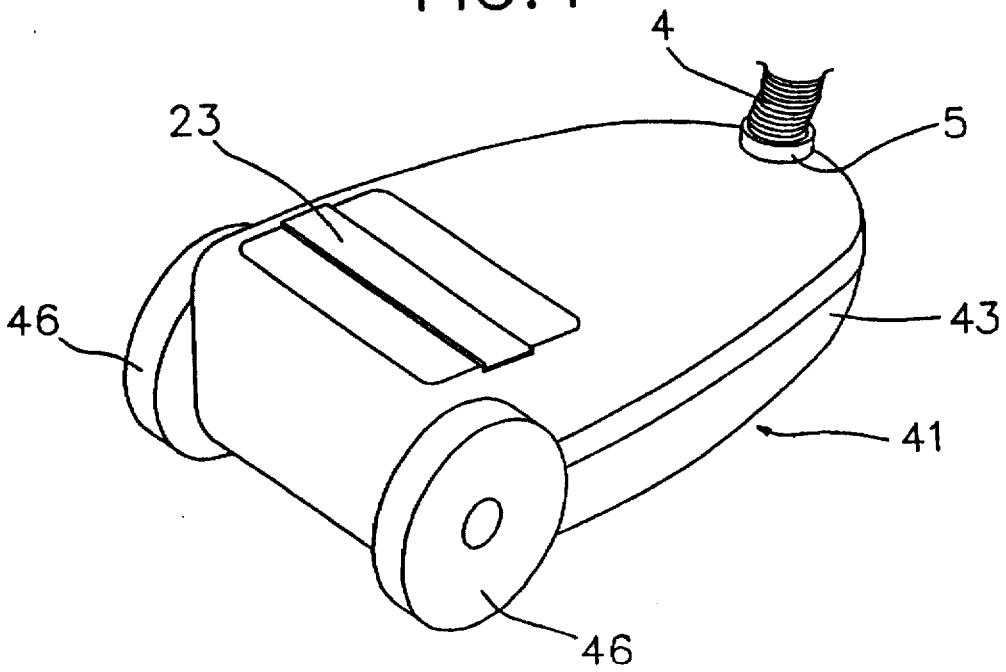
FIG. 4 is a perspective view for showing a body of a cleaner having a switch button for operating a power on/off switch and a cord-winding unit according to one embodiment of the present invention.

FIG. 4 is a perspective view for showing a body 43 of a cleaner 41 having a switch button 23 for operating a power on/off switch and a cord-winding unit according to one embodiment of the present invention. As illustrated in FIG. 4, body 43 of cleaner 41 includes switch button 23 for operating the power on/off switch and the cord-winding unit. Reference numeral indicates wheels 46 to move body 43. Reference numeral 4 indicates a hosepipe. Hosepipe 4 provides an air passageway from the exterior to body 43. Reference numeral 5 indicates the connection/separation part. Connection/separation part 5 connects or separates hosepipe 4 with or from body 43.

Figure 5:
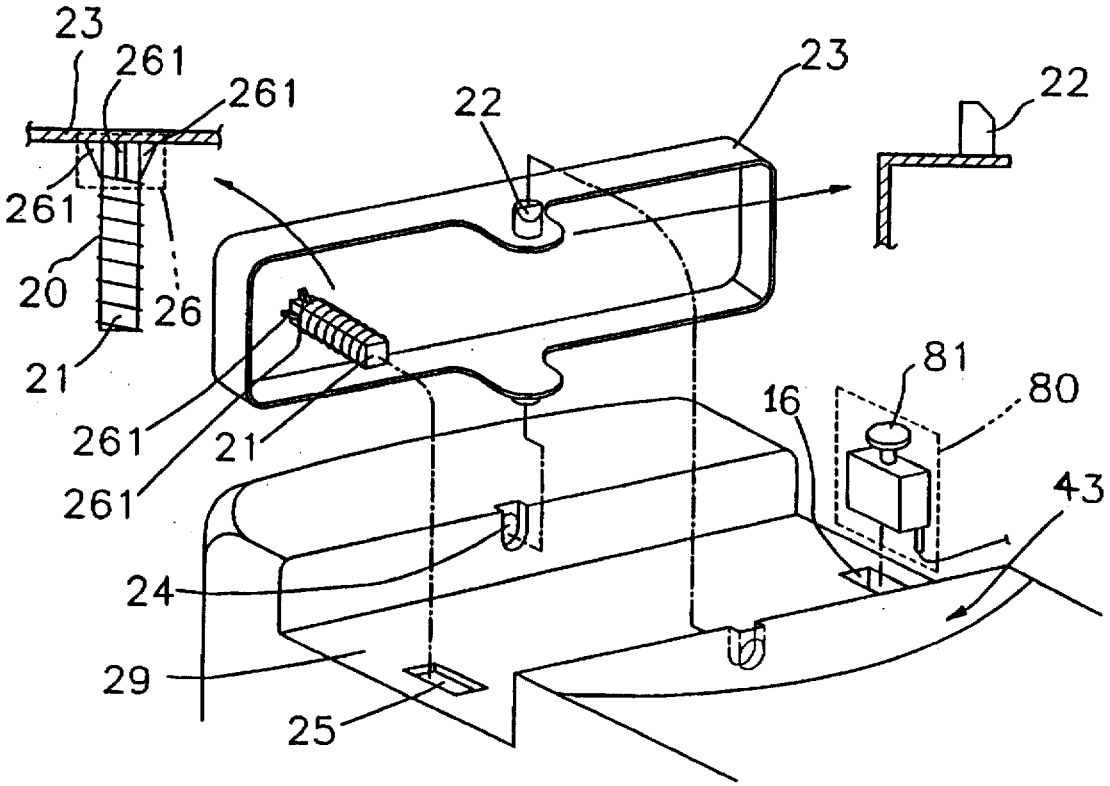
FIG. 5 is a perspective view for showing the body of the cleaner of FIG. 4 in which the switch button for operating the power on/off switch and the cord-winding unit is explored.

FIG. 5 is a perspective view for showing the body of the cleaner of FIG. 4 in which the switch button for operating the power on/off switch and the cord-winding unit is explored. As illustrated in FIG. 5, switch button 23 is formed in the shape of a lidless box. First and second protrusions 22 are formed on middle portions of opposite sides of switch button 23 respectively. The middle portions are made of elastic materials respectively. Accordingly, if a pressure is inwardly exerted on the middle portions, the middle portions become bent inwardly, and when the pressure is removed, the middle portions are restored to their original shapes. The end of each of first and second protrusions 22 is tapered as illustrated in FIG. 5. Third protrusion 21 is formed on the inner bottom of the lidless box; and formed near the end portion of the inner bottom of switch button 23. A rib portion 26 having a plurality of ribs 261 along the exterior circumference of third protrusion 21 is formed on the connection portion of switch button 23 and third protrusion 21. Each of the plurality of ribs 261 is tapered with its width going narrower from one end to the other. One end of each of the plurality of ribs 261 is formed broader on the side of the switch button 23 for operating the power on/off switch and cord-winding unit. That is, each of the plurality of ribs 261 has a triangular shape. Further, a spring 20 is inserted in third protrusion 21. One end of spring 20 is fixed by rib portion 26.

Meanwhile, a switch button receiving recess 29 for receiving switch button 23 is formed on body 43 of cleaner 41. First and second protrusion receiving recesses 24 are formed in middle upper portions of opposite walls of receiving recess 29 to receive first and second protrusions 22 respectively. First and second openings 16 and 25 are formed on the bottom of switch button receiving recess 29. Third protrusion 21 is inserted in second opening 25.

Figure 1:
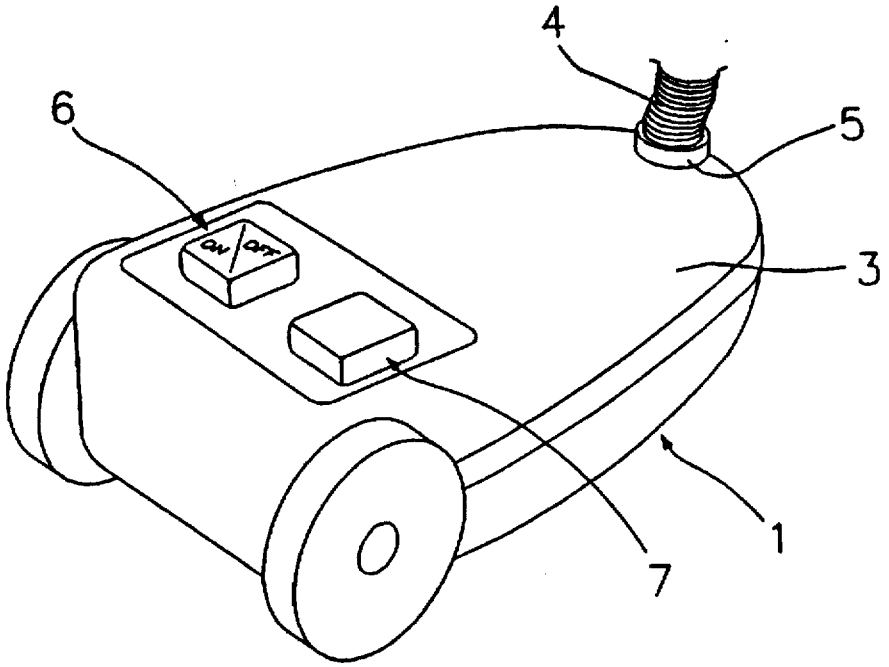
FIG. 1 is a perspective view for showing a body of a conventional cleaner having a power on/off switch and a cord-winding unit operation switch.
Figure 2:
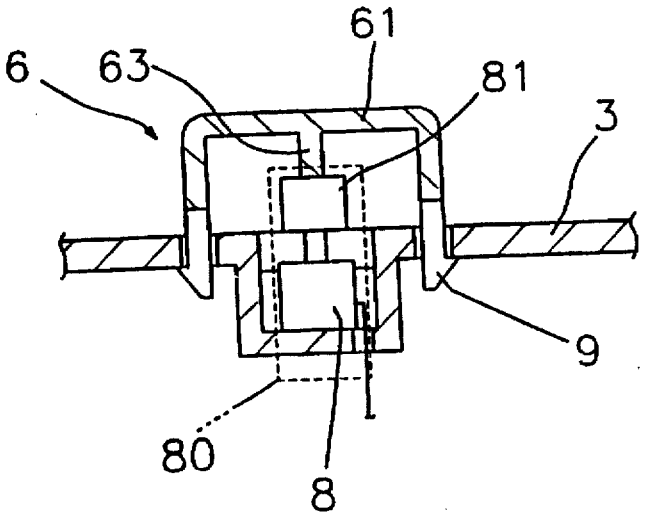
FIG. 2 is a cross-sectional view for the power on/off switch installed in the body of FIG. 1.

Further, a push button switch 80 as illustrated in FIG. 2 is installed in body 43. Push button switch 80 may be a push button switch available from a market place. Push button switch 80 includes a switch head 81. Whenever switch head 81 of push button switch 80 is pressed, push button switch 80 repeatedly turns on or off.

Figure 3:
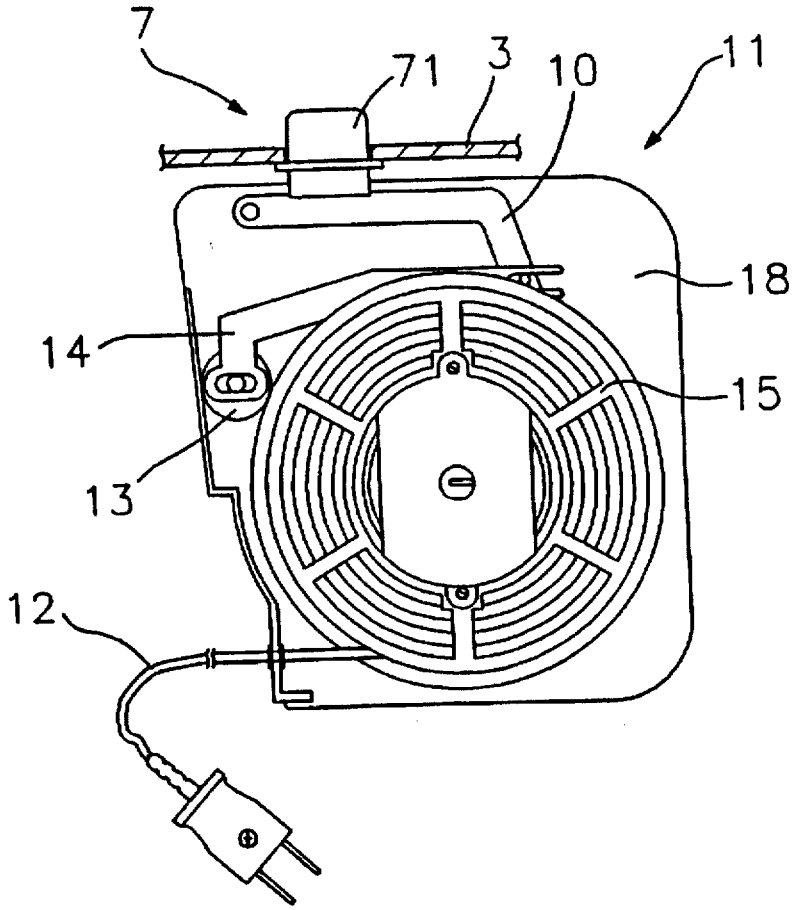
FIG. 3 is a cross-sectional view for the cord-winding unit operation switch installed in the body of FIG. 1.

On the other hand, cord-winding unit 11 is installed in body 43 as illustrated in FIG. 3. Cord-winding unit 11 has a cord-winding unit operation lever 10. One end of cord-winding unit operation lever 10 is connected with one end of stop lever 14. The other end of cord-winding unit operation lever 10 is rotatably fixed on a side wall 18 of cord-winding unit 11. Stop lever 14 controls the incoming and outcoming of power cord 12 into and out of cord-winding unit 11. Usually, power cord 12 is wound up around reel 15. The other end of stop lever 14 is rotatably fixed on side wall 18, and is connected with stop roller 13 for controlling the rotation of reel 15. The constitution of cord-winding unit 11 mentioned above may be one used in a cord-winding unit of a conventional cleaner.

Figure 6:
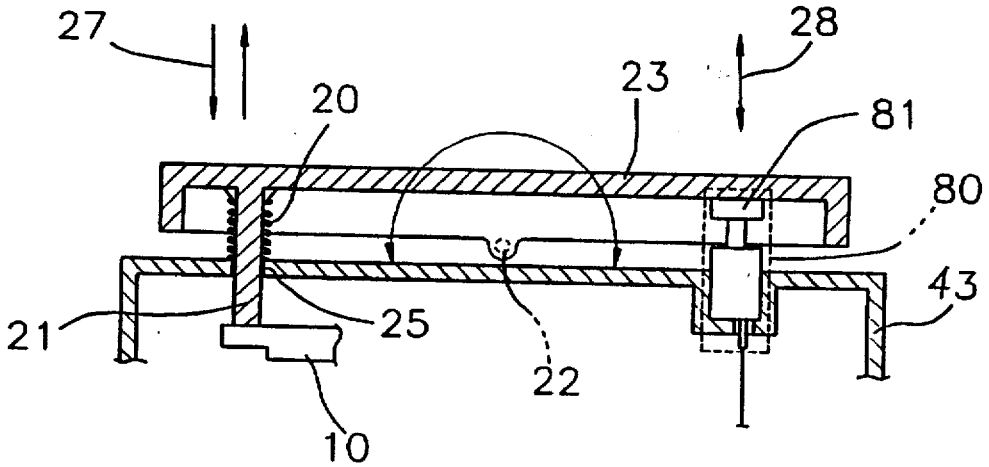
FIG. 6 is a view for illustrating the switching operation of the switch button of FIG. 4.

FIG. 6 is a view for illustrating the switching operation of the switch button of FIG. 4. Referring to FIGS. 5 and 6, one end of third protrusion 21 is laid on cord-winding unit operation lever 10 through second opening 25. At this time, spring 20 is disposed between switch button 23 and the floor of switch button receiving recess 29. Switch head 81 of push button switch 80 comes in touch with switch button 23.

Referring to FIG. 6, switching operations of switch button 23 for operating the power on/off switch and cord-winding unit will be explained hereunder. As illustrated in FIG. 6, switch button 23 connected with body 43 performs seesaw movements about the axis of first and second protrusions 22. Reference numeral 27 indicates movement directions and pressing positions of switch button 23 to operate cord-winding unit 11. Reference numeral 28 indicates operation directions and pressing positions for on/off switching of push button switch 80. Accordingly, at the position of reference numeral 27, if switch button 23 is pressed downwards, cord-winding unit operation lever 10 is operated to enable power cord 12 to come into or out of cord-winding unit 11. Switch button 23 returns to its original position by an elastic force of spring 20. At the position of reference numeral 28, if switch button 23 is pressed downwards, push button switch 80 turns on or off. Due to the above operations of switch button 23, the operations of the cord-winding unit and the power on/off switch can be obtained as in a conventional cleaner.

As mentioned above, in a cleaner having a switch button for operating a power on/off switch and a cord-winding unit according to the present invention, the assembly processes of the button become simpler and require a shorter time period.

It is understood that various other modifications will be apparent to and can be readily made by those skilled in the art without departing from the scope and spirit of this invention. Accordingly, it is not intended that the scope of the claims appended thereto be limited to the descriptions set forth herein, but rather that the claims be constructed as encompassing all the features of the patentable novelty that reside in the present invention, including all the features that would be treated as equivalents thereof by those skilled in the art to which this pertains.

What is claimed is:

1. A cleaner including a body having a cord-winding unit with a cord-winding unit operation lever for controlling incoming and outgoing of a power cord thereinto and therefrom and a power on/off switch, the cleaner comprising:

a switch button for operating the power on/off switch and the cord-winding unit operation lever by performing seesaw movements of the switch button, wherein the switch button has first and second protrusions on middle portions of opposite sides of the switch button, the first and second protrusions are made of an elastic material respectively and the seesaw movements are performed about the first and second protrusions; and a body having a switch button receiving recess for receiving the switch button therein, and having first and second protrusions receiving recesses for correspondingly receiving the first and second protrusions respectively in order for the switch button to enable the seesaw movements.

2. The cleaner as claimed in claim 1, wherein one end portion of each of the first and second protrusions is tapered, the one end portion of each of the first and second protrusions being respectively inserted into the first and second protrusion receiving recesses.

3. The cleaner as claimed in claim 1, wherein the switch button is formed in a shape of a lidless box, the switch button comprising:

a third protrusion formed on the bottom of the lidless box and formed near one end portion of the inner bottom of the switch button, and a spring inserted in the third protrusion, the bottom of the switch button receiving recess having first opening for receiving the power on/off switch and a second opening for inserting the third protrusion to reach the cord-winding unit operation lever.

4. The cleaner as claimed in claim 3, wherein the third protrusion has a plurality of ribs along the exterior circumference thereof on the connection portion with the switch button, each of the plurality of ribs has a triangular shape which is tapered with its width narrower from one end to the other.

* * * * *